United States Patent [19]

Tsai

[11] Patent Number: 5,005,530

[45] Date of Patent: Apr. 9, 1991

[54] FURNACE RADIANT SECTIONS WITH VERTICAL HEAT EXCHANGER TUBING, AND CONVECTION SECTION

[76] Inventor: Frank W. Tsai, 1842 Alpine Dr., San Marino, Calif. 91108

[21] Appl. No.: 535,408

[22] Filed: Jun. 8, 1990

[51] Int. Cl.[5] ..... F22B 31/00

[52] U.S. Cl. ..... 122/240.3; 29/890.051; 110/234; 122/4 R; 122/13.1

[58] Field of Search ..... 122/13 R, 240, 4 R; 29/890.051; 110/234

[56] References Cited

U.S. PATENT DOCUMENTS

| | | | |
|---|---|---|---|
| 3,172,739 | 3/1965 | Koniewiez | 122/240 R |
| 3,182,638 | 5/1965 | Lee et al. | 122/240 R |
| 3,566,845 | 3/1971 | Barnes | 122/240 R |

*Primary Examiner*—Edward G. Favors

*Attorney, Agent, or Firm*—William W. Haefliger

[57] ABSTRACT

The method of combining two furnaces into one, each furnace having a lower radiant section that includes upright walls and horizontal heat exchanger tubes, and an upper convection section, the lower section having associated fuel burners, including removing the horizontal heat exchanger tubes from the lower section; extending the lower section upright walls vertically upwardly, and providing space between the vertically extended lower sections; providing top walls over the vertically extended lower sections, and providing vertically extending heat exchanger tubing and suspending the tubing vertically within the vertically extended lower radiant sections, to be heated by hot gases produced by combustion of fuel supplied via the burners; and providing and locating an upright convection section of the furnace in flow receiving communication with the lower sections via lateral passages therefrom.

13 Claims, 3 Drawing Sheets

127
2
27
125a
126
125
11d
11
17
2
11a
22
20
17
10
15
21
12
13
14
AIR
HxCy
16
16

127

27
125a
19
126
18
117
11a
17

FURNACE RADIANT SECTIONS WITH VERTICAL HEAT EXCHANGER TUBING, AND CONVECTION SECTION

BACKGROUND OF THE INVENTION

This invention relates generally to heaters or furnaces, and more particularly concerns improvements to furnaces of the type containing heat transfer tubing that extends horizontally in both "radiant" lower furnace sections and "convective" upper furnace sections.

In the above type furnace, which is conventional, complex support arrangements are required for the banks of horizontally extending tubing. Removal and replacement of such complex supports is required in order to periodically remove and clean the tubing, all of which is time consuming and expensive. There is need for a furnace construction which overcomes these problems, and particularly a reconstructed furnace which employs original furnace materials, to reduce capital cost and to reduce cost of periodic horizontal tubing removal and repair.

SUMMARY OF THE INVENTION

It is a major object of the invention to provide a method of furnace re-construction, and a reconstructed furnace unit itself, which meets the above need. Basically, the invention contemplates re-constructing two furnaces of conventional type to provide one improved furnace, in which tubing structure may be suspended vertically in lower "radiant" furnace sections, thereby eliminating need for complex supports for horizontal tubing structures.

Accordingly, the invention is directed to a method of combining two furnaces into one, each furnace having a lower radiant section that includes upright walls and horizontal heat exchanger tubes, and an upper convection section, the lower section having associated fuel burners, that includes:

(a) removing the horizontal heat exchanger tubes from the lower sections, (b) extending the lower section upright walls vertically upwardly, and providing space between the vertically extended lower sections, (c) providing top walls over the vertically extended lower sections, and providing vertically extending heat exchanger tubing and suspending that tubing vertically within said vertically extended lower radiant sections, to be heated by hot gases produced by combustion of fuel supplied via the fuel burners, (d) and providing and locating an upright furnace convection section in flow receiving communication with the lower sections, via lateral passages therefrom.

As will appear, the method of step (b) above typically may include supplying additional vertical walls and locating said walls above the vertical walls of lower sections of said two furnaces; and also removing the upper convection sections from the lower sections of the two furnaces, prior to said (c) step.

Additional steps may include locating said convection section above the space between said two lower sections; providing the lateral passages in upper side walls of said two lower sections; and providing a top wall over the space between the two lower sections and beneath the lateral passages.

Operation of the furnace includes passing combustion gases upwardly on the two lower radiant sections, to transfer heat to the vertical tubing therein; laterally combining the hot gases from the two lower sections, and flowing the combined hot gas stream through the single upper convection sections of the furnace to subsequently exit the furnace.

Furnace apparatus embodying the invention includes:

(a) two lower radiant furnace sections extending in close side-by-side relation, and having interiors, (b) upper walls over the respective interiors, and heat transfer tubing suspended to extend vertically in said interiors, below said upper walls, (c) a single upper convective furnace section having a lower entrance, (d) and means on the lower section to receive hot combustion gases therefrom and to transfer the gases laterally and upwardly from the lower sections to the upper section, via said entrance.

As will be seen, the upper section typically contains heat transfer tubing.

These and other objects and advantages of the invention, as well as the details of an illustrative embodiment, will be more fully understood from the following specification and drawings, in which:

DRAWING DESCRIPTION

DETAILED DESCRIPTION

Figure 1:
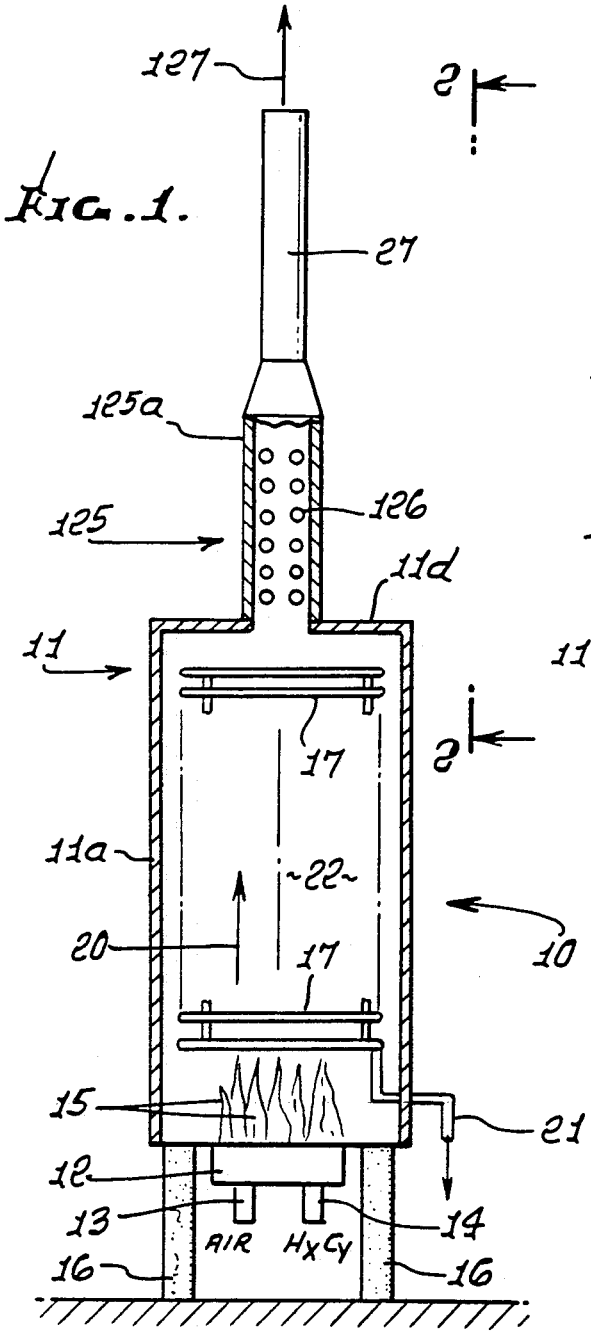
FIG. 1 is an elevation showing a conventional furnace.

In FIG. 1, conventional furnace or heater apparatus 10 is shown, and may comprise a reactor or oil heater as usable in a refinery. Upright housing 11 includes a lower section 11*a*, associated with hydrocarbon fuel burners and windboxes designated at 12. The latter receive air and hydrocarbon fluid, as via lines 13 and 14 to produce burner flames at 15. Concrete piers 16 support the housing.

Located within the radiant section 11*a* of the housing are horizontal heat transfer tubes 17, to which process fluids are fed from a source 18 and via a valve 19 and heat transfer tubing 126 discussed below. The fluid is heated within the tubes 17, as by the hot combustion gases flowing upwardly at 20. Hot process fluid leaves the tubes and the housing at 21. The tubes 17 typically extend horizontally in open reaction zone 22 for heat absorption by radiation from hot gases flowing upwardly through the length of the housing.

Figure 2:
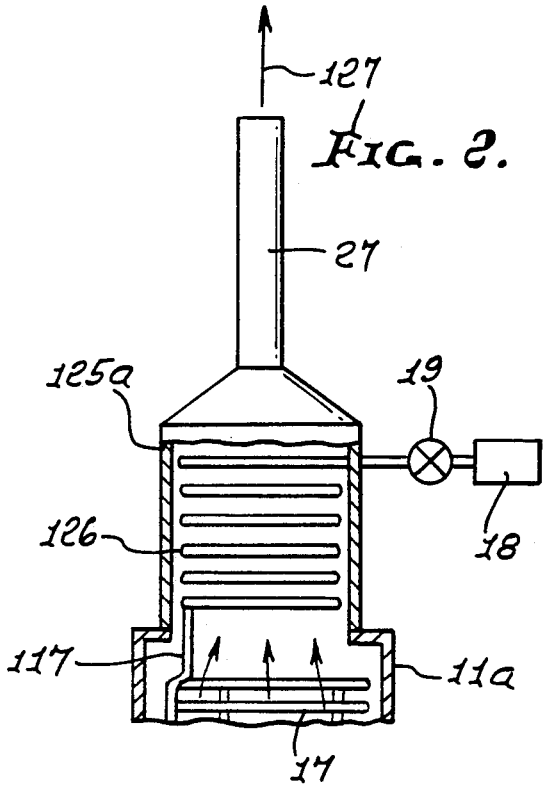
FIG. 2 is an elevation taken on lines 2—2 of FIG. 1.

The hot gases flow upwardly in the housing to and through a narrowed section 125 at the top 11*d* of the housing. The lower "convective" extent 125*a* of the stack contains additional heat transfer tubing 126 extending as seen in FIGS. 1 or 2. Thus, the horizontal tubes 126 may be connected in series to deliver hot fluid to the tubes 17, via junction 117. The tubes 126 are spaced, and/or staggered, to be contacted by the hot gases entering and flowing upwardly in the stack lower extent 125*a*. Hot gases leave the stack 27 at 127.

Figure 3:
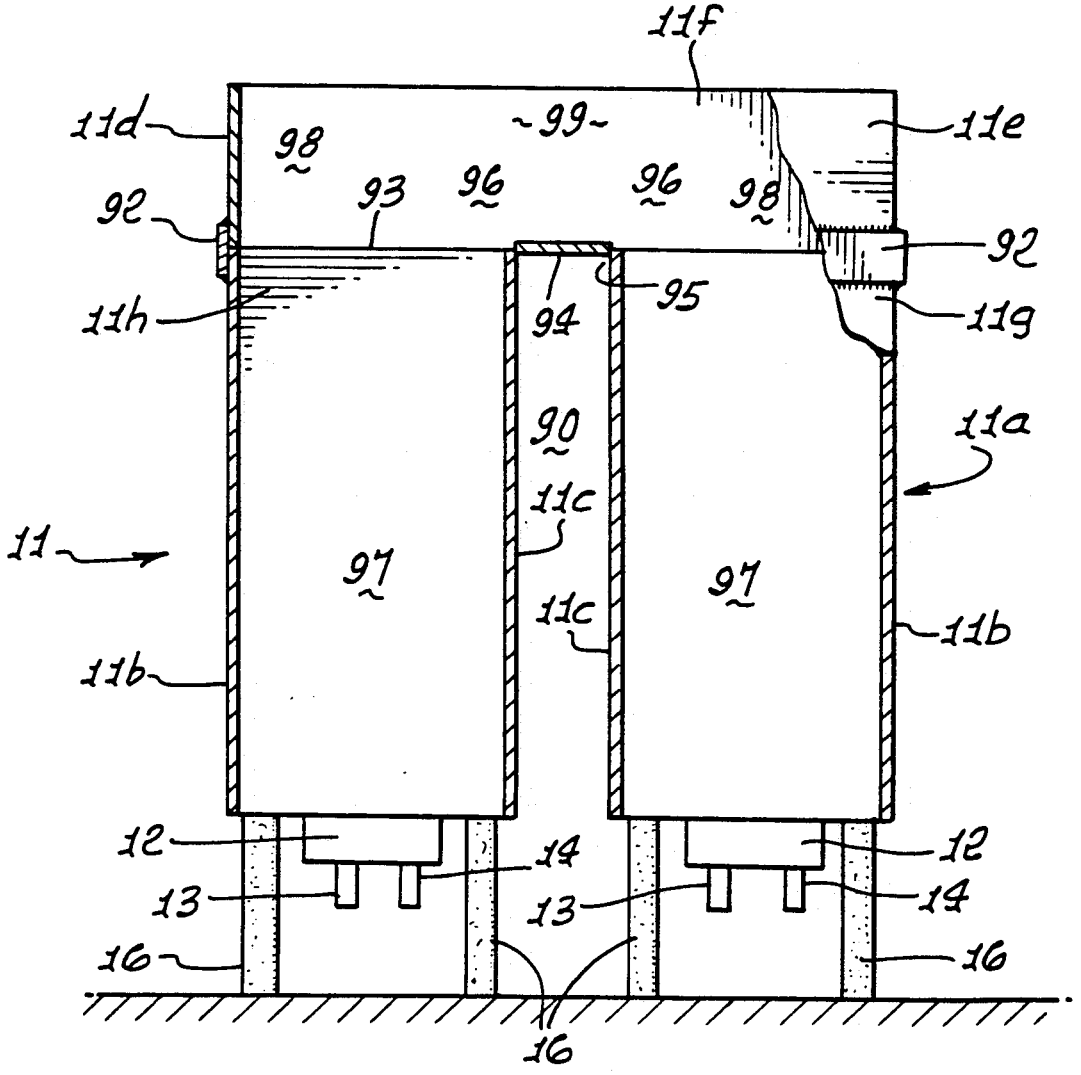
FIG. 3 is an end elevation showing modification of two conventional furnaces, during their combination to provide a single improved furnace.

In FIG. 3, two of the furnace housings 11 have been moved into proximity to one another, but are separated by space 90. Lower radiant sections 11*a* remain the same, as do associated burners in boxes 12. Thus upright walls 11*b* and 11*c* are the same. The horizontal tubes 17, however, are removed. The lower section upright walls on three sides of each furnace are extended upwardly, as by installing two auxiliary upright walls 11*d* above walls 11*b*, and two upright walls 11*e* and 11*f* that extend above front and rear lower walls 11*g* and 11*h*. Plates 92 may be welded to the lower and upper walls, to bridge the joint 93 therebetween. This also ties the two furnaces together. A narrow top wall 94 is provided to extend over space 90, and is welded to the tops of walls 11*c*, as at 95. This also ties the two furnaces together. In this construction process, two lateral openings are provided at 96, at the junctions of the interior vertical spaces 97 and 98 with the common interior space 99 above top wall 94, for purposes as will be made clear in FIG. 4.

Figure 4:
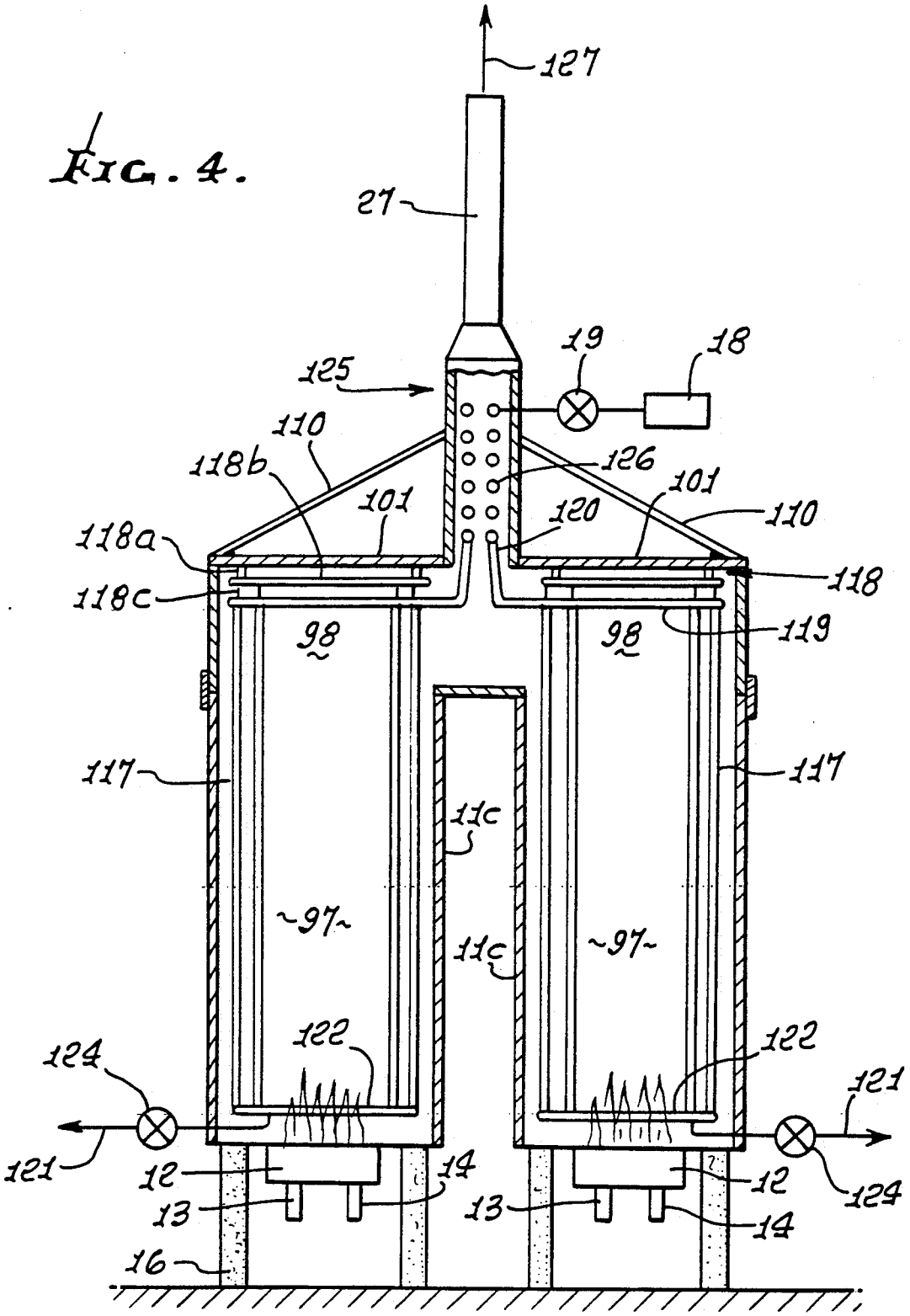
FIG. 4 shows the final single furnace construction.

Referring to FIG. 4, the construction is now completed. Top walls 101 are provided to extend over the vertically extended lower sections, and interiors 97 and 98. An upright convection section 125, as retrieved from one or two of the furnaces in FIG. 1, for example, (or provided new), is now installed in the position shown, above space 99, so as to be in flow receiving communication with the interiors 97 and 98 of the two vertically extended lower radiant sections 11*a*. Hot combustion gases may now flow upwardly within interiors 97 and 98, then laterally through the openings 96 above walls 11*c*, and then upwardly to enter the narrower convection section 125, as before. Support framing may be provided as at 110.

The above now makes it possible to suspend vertically elongated heat transfer tubing 117 in the interiors 97 and 98, as for example is shown, without complex supports between the vertical tubes. Suspension of the tubes may be in any convenient manner, as for example by hanger structures 118 including uprights 118*a* connected to walls 101, brackets 118*b*, and pins 118*c*. Upper manifolds may be provided at 119, and connected to tubes 117 and at 120 to tubes 126, as shown. Lower manifolds 122 may be connected to the lower ends of tubes 117, and may deliver heated process fluid at 121 to the exterior, as via valves 124.

Removal and cleaning or servicing of the vertical tubes 117 is much easier than removal and repair of tubes 17, in FIG. 1.

I claim:

1. The method of combining two furnaces into one, each furnace having a lower radiant section that includes upright walls and horizontal heat exchanger tubes, and an upper convection section, the lower section having associated fuel burners, that includes:

(a) removing said horizontal heat exchanger tubes from said lower section, (b) extending said lower section upright walls vertically upwardly, and providing space between the vertically extended lower sections, (c) providing top walls over said vertically extended lower sections, and providing vertically extending heat exchanger tubing and suspending said tubing vertically within said vertically extended lower radiant sections, to be heated by hot gases produced by combustion of fuel supplied via said burners, (d) and providing and locating an upright furnace convection section in flow receiving communication with said lower radiant sections, via lateral passages therefrom.

2. The method of claim 1 wherein said (b) step includes supplying additional vertical walls and locating said walls above the vertical walls of lower sections of said two furnaces.

3. The method of claim 1 including removing the upper convection sections from the lower sections of the two furnaces, prior to said (c) step.

4. The method of claim 1 wherein said (d) step includes locating said convection section above the space between said two lower sections.

5. The method of claim 1 including providing said lateral passages in upper side walls of said two lower sections.

6. The method of claim 4 including providing said lateral passages in upper side walls of said two lower sections, and providing a top wall over said space between the two lower sections and beneath said lateral passages.

7. The method of claim 1 including passing hot combustion gases upwardly in the lower sections to radiantly transfer heat to the vertically extending tubing therein; combining said gases flowing from the two lower sections, and passing the combined gases upwardly in said upper convective sections.

8. The method of claim 7 wherein the gases are caused to flow laterally from the two lower sections for combination of the gases.

9. The method of claim 1 including orienting heat transfer tubing to extend horizontally in the upper sections.

10. The method of claim 7 including operating gas burners to produce said hot combustion gases.

11. The combination of claim 10 wherein said upright walls of said lower radiant sections including original walls of two existing furnace lower radiant sections, and add-on walls that extend the heights of said existing lower radiant sections, to levels such that vertically elongated tubing may be suspended in said interiors.

12. In a furnace, the combination comprising (a) two lower radiant sections which are laterally spaced apart, and an upper convection section, (b) said lower radiant sections having upright walls and associated fuel burners, and top walls extending over upright interiors formed in said lower sections, (c) heat exchanger tubing suspended to extend vertically in said interiors, to be heated by hot gases produced by combustion of fuel supplied via said burners, (d) said convection section communicating with the upper interiors of said lower sections via lateral passages therefrom, (e) there being a generally horizontal top plate which extends over vertically elongated space between said sections, the upright wall of each sections which is closest to the other sections being adjacent said vertically elongated space and connected to said top plate, and said upper convection section being located generally above said plate, said top plate located below said lateral passages.

13. The combination of claim 11 wherein said top walls also extend over said plate.

* * * * *